US008973397B2

(12) United States Patent
Rillo Millán et al.

(10) Patent No.: US 8,973,397 B2
(45) Date of Patent: Mar. 10, 2015

(54) HELIUM-RECOVERY PLANT

(75) Inventors: Conrado Rillo Millán, Zaragoza (ES); Leticia Tocado Martínez, Zaragoza (ES)

(73) Assignees: Consejo Superior de Investigaciones Cientificas (CISC), Madrid (ES); Universidad de Zaragoza, Zaragoza (ES); GWR Instruments, San Diego, CA (US)

( * ) Notice: Subject to any disclaimer, the term of this patent is extended or adjusted under 35 U.S.C. 154(b) by 315 days.

(21) Appl. No.: 13/452,630

(22) Filed: Apr. 20, 2012

(65) Prior Publication Data

US 2013/0104597 A1 May 2, 2013

Related U.S. Application Data

(63) Continuation-in-part of application No. PCT/ES2010/070632, filed on Sep. 28, 2010.

(30) Foreign Application Priority Data

Oct. 26, 2009 (ES) ..... 200930904

(51) Int. Cl.

| | |
|---|---|
| ***F25J 1/00*** | (2006.01) |
| ***F25J 3/00*** | (2006.01) |
| ***F25J 1/02*** | (2006.01) |
| ***F25J 3/08*** | (2006.01) |

(52) U.S. Cl.

CPC ..... *F25J 1/0007* (2013.01); *F25J 1/0065* (2013.01); *F25J 1/025* (2013.01); *F25J 1/0269* (2013.01); *F25J 1/0276* (2013.01); *F25J 3/08* (2013.01); *F25J 2270/912* (2013.01); *F25J 2290/60* (2013.01)

USPC ..... 62/608; 62/610; 62/639

(58) Field of Classification Search

CPC ..... F25J 1/0007; F25J 1/0276; F25J 2215/30; F25J 2270/91; F25J 1/0245; F25J 2270/912

USPC ..... 62/6, 608, 610, 639

See application file for complete search history.

(56) References Cited

U.S. PATENT DOCUMENTS

| | | | | |
|---|---|---|---|---|
| 2,458,894 | A | 1/1949 | Collins | |
| 3,205,669 | A | 9/1965 | Grossmann | |
| 3,355,902 | A | 12/1967 | Crawford et al. | |
| 3,415,077 | A | 12/1968 | Collins | |
| 3,438,220 | A | 4/1969 | Collins | |
| 3,792,591 | A * | 2/1974 | Collins | 62/639 |

(Continued)

OTHER PUBLICATIONS

International Search Report (PCT/ES2010/070632—Filed: Sep. 28, 2010); 2 pages.

*Primary Examiner* — Frantz Jules
*Assistant Examiner* — Webeshet Mengesha
(74) *Attorney, Agent, or Firm* — The Maxham Firm

(57) ABSTRACT

A helium recovery plant adapted to filter, compress, and purify helium gas collected from one or more helium-using instruments, as well as to liquefy and redistribute the purified gas within a closed system. The recovery plant is adapted to match the purification and liquefaction rate of the system with the consumption rate of the coupled instruments. Additionally, the recovery plant is adapted to match the liquefaction rate of a liquefaction module with a boil-off rate of liquid helium within a Dewar thereof. The recovery plant is further adapted to recycle helium therein in an effort to achieve zero loss.

17 Claims, 1 Drawing Sheet

(56) References Cited

U.S. PATENT DOCUMENTS

| | | | | |
|---|---|---|---|---|
| 4,444,572 | A * | 4/1984 | Avon et al. | 95/97 |
| 4,525,186 | A | 6/1985 | Garwin | |
| 5,144,806 | A | 9/1992 | Frenzel et al. | |
| 2006/0230766 | A1 * | 10/2006 | Takeda | 62/48.2 |
| 2009/0211297 | A1 | 8/2009 | Schmidt | |
| 2011/0168674 | A1 * | 7/2011 | Mayumi et al. | 216/67 |

* cited by examiner

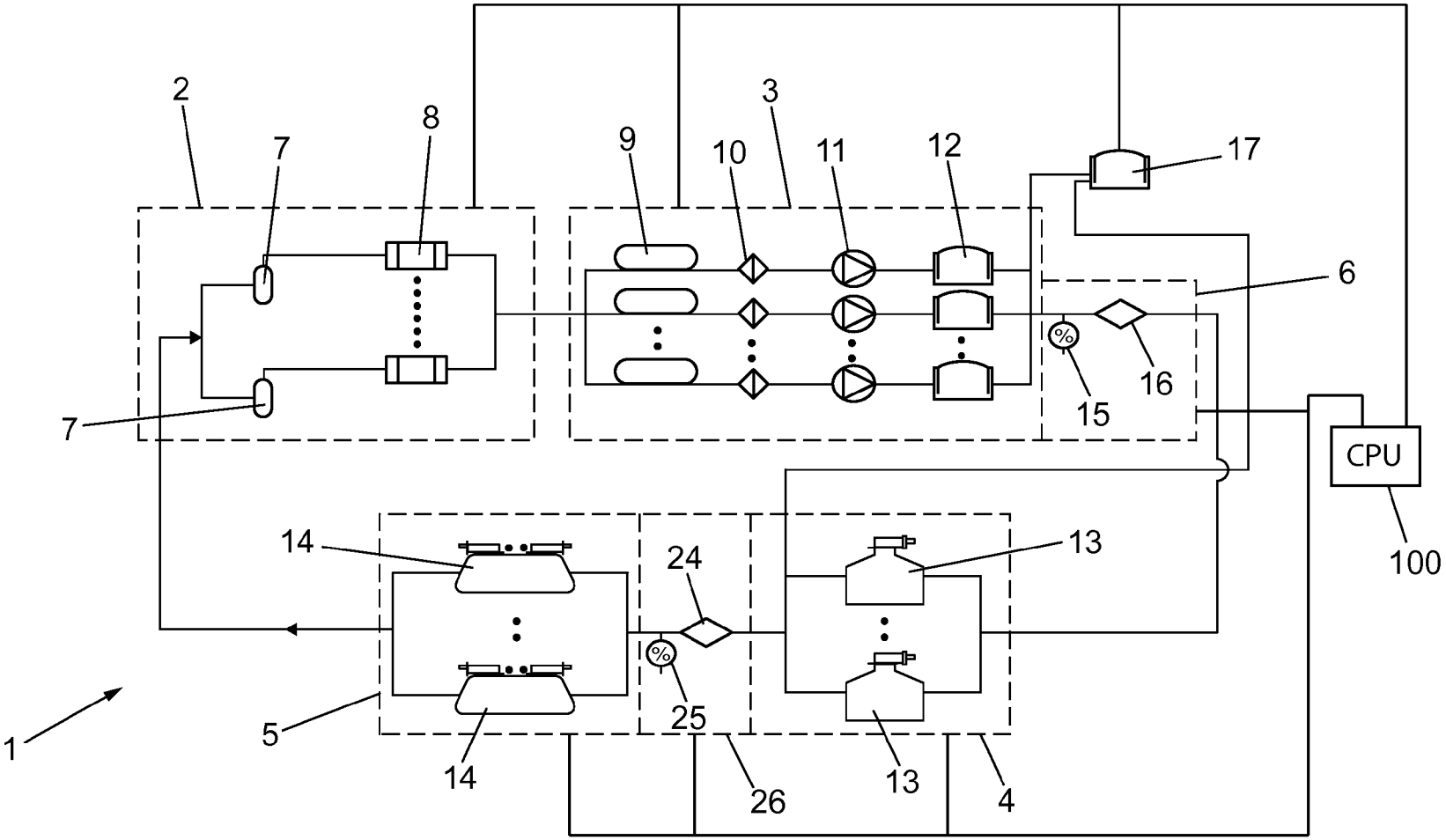
CPU
100
6
17
16
15
12
11
3
10
9
8
7
2
7
13
4
13
26
24
25
14
14
5
1

HELIUM-RECOVERY PLANT

CROSS-REFERENCE TO RELATED APPLICATIONS

This application claims priority from PCT serial number PCT/ES2010/070632, filed 28 Sep. 2010 with priority from Spanish application Serial No.: P200930904, filed 26 Oct. 2009, the contents of both of which are hereby incorporated by reference.

BACKGROUND OF THE INVENTION

1. Field of the Invention

This concept relates generally to gas recovery plants, otherwise known as "gas liquefaction plants," and more particularly to a modular gas recovery plant adapted for efficient gas supply, recovery, and storage in an effort to achieve zero helium loss within a closed system.

2. Discussion of Related Art

Although helium (He) is the second most abundant element in the universe, on earth it is scarce and only extracted with difficulty. Helium is found underground, in a gaseous state, as a byproduct of natural radioactive disintegrations. Separation methods are used to isolate helium from other gases found in natural gas wells.

Gas-phase helium is generally transported in containers under high-pressure, while in liquid-phase such helium is generally transported in thermally-insulated containers known as "Dewars" which are adapted to contain helium at or near atmospheric pressure.

Liquid-phase helium is generally obtained from high-power industrial liquefaction plants, referred to herein as "Class XL" liquefiers, which produce liquefied helium in quantities greater than 1000 liters/hour, and require more than 1000 kW of power. These Class XL plants generally yield a liquefaction efficiency of around one liter/hour/kW. Within these Class XL liquefiers, the helium gas undergoes one or more cyclical thermodynamic processes and the gas is then cooled until it reaches its liquefaction temperature. The technology of these liquefaction plants dates from the last century, and can be referred to as "Collins Technology," examples of which are disclosed in U.S. Pat. Nos. 2,458,894; 3,415,077; and 3,438,220, each issued to Samuel C. Collins.

Moreover, in view of the Class XL liquefiers specified above, various other liquefaction classes may be referred to herein. For example, Class L liquefiers will refer to those liquefiers which produce greater than 100 liters/hour; and Class M liquefiers will refer to those liquefiers which produce greater than 20 liters/hour. All of these large scale liquefiers typically achieve a liquefaction efficiency of about 10 liters/day/kilowatt of input power.

The scientific and industrial applications of helium gas are numerous. In a gas-phase, helium under ambient temperature is useful for welding and as a means for floating balloons. Moreover, in a liquid-phase, helium at atmospheric pressure is generally cold, at or near −269° C., and thus is commonly used for refrigeration of medical and scientific equipment, among other things. Helium is therefore considered to be a valuable resource, lending interest to advancements in helium gas recovery and reuse, especially such recovery and reuse as might be accomplished with negligible or zero loss.

In modern recovery plants, helium gas is generally processed throughout multiple stages, that is, stage 1: recovery; stage 2: storage under pressure; stage 3: purification; stage 4: liquefaction; and stage 5: distribution. These modern plants are generally known to suffer losses in each and every stage as outlined above. Furthermore, even where the loss is very small at one or more stages, when aggregated together the total loss can be significant and often exceeds 10% per cycle. Furthermore, these plants require complex facilities for the storage of vast volumes of highly pressurized gas, regardless of the liquid consumption rate at the particular facility, since the liquefaction rate generally cannot be coordinated, regulated, or adapted for consumption. Finally, without capability to adjust the liquefaction rate, the liquefied helium is produced in volumes that exceed consumption, which necessitates the use of very large storage Dewars, and consequently requires smaller transportation Dewars to distribute the liquid to end users of the liquid gas.

With the advent of closed-cycle refrigerators capable of achieving temperatures below that of liquid helium, such as those based on known Gifford McMahon (GM) and Pulse Tube technologies, liquefiers having lower liquefaction rates and lower maintenance requirements have been developed. In such liquefiers, the gas to be liquefied does not undergo complex thermodynamic cycles, but rather condenses by convection and direct thermal exchange with the different stages of the cryogenic refrigerator and is subsequently stored in a Dewar. However, at present there has yet to be developed such a helium recovery plant based on GM or Pulse Tube technologies which is adapted to yield liquefaction efficiencies comparable to the class XL liquefaction plants described above; that is, one liter/hour/kW.

In an attempt to solve the problem for an individual medical or scientific instrument, that is, providing liquefied helium as needed, liquefaction systems have been developed which incorporate a closed-cycle refrigerator adapted to collect and re-condense helium that is evaporated by the medical or scientific instrument using helium. However, these systems are constructed to use one refrigerator per instrument, and thus underutilize the refrigerator's capacity. For installations in which the direct installation of a refrigerator is technically not feasible, these closed-cycle refrigerator systems do not solve the problem of providing helium as and when required. Moreover, when a large number of instruments require refrigeration, the acquisition and maintenance costs associated with the corresponding number of refrigerators make this solution impractical.

Accordingly, if they were available, gas recovery and purification plants, especially helium-gas recovery and purification plants, based on closed-cycle refrigerator technologies, would be of an immediate and significant interest. With such plants, helium gas being employed as a trace gas in leak-detection processes, or as a cooling medium, could potentially be recovered and reutilized over several cycles with little or no loss, thereby reducing of the need to acquire virgin helium gas. Moreover, the recovery of helium would provide an economic advantage for processes that require pressurized helium gas.

SUMMARY OF EMBODIMENTS OF THE INVENTION

A closed-cycle, high-efficiency, automated helium recovery plant is here described. This high-efficiency helium recovery plant is adapted for computerized control and switching between a liquefaction mode and a standby mode, and is further adapted to collect, re-liquefy, and redistribute recovered helium amongst a plurality of medical or scientific instruments or other equipment. As helium gas is utilized among several instruments within the closed system, it is recovered and subsequently liquefied before being re-introduced to the equipment such that a finite supply of helium is continuously recycled, without or at least with only minimal loss, within the closed system, thus reducing the cost associated with resupply of virgin helium gas.

The helium recovery plant disclosed herein covers a liquefaction range of between zero liters/hour when operated in standby mode, and more than 10 liters/hour when operating in liquefaction mode. In this regard, this helium recovery plant yields liquefaction rates generally comparable to the prior art Class M plants. Additionally, the performance efficiency of the helium recovery plant is at least 4 liters/day/kW, nearly matching the production and performance attributes associated with Class L plants, but with simplified operating and maintenance procedures.

In one embodiment, the recovery plant comprises five modules, wherein the modules and associated functions thereof include:

(i) a recovery module for collecting and storing helium gas from one or more helium using instruments;

(ii) a gas collection and storage module adapted to collect gas under atmospheric pressure in a balloon or a container, filter the gas through one or more filters, pressurize the gas to an absolute pressure above 2 bar by means of a purge-free compressor, and store the gas in a gas storage container at the compressor output pressure;

(iii) a purification module via, for example, a closed-cycle purifier, which allows the removal of impurities such as water vapor and air;

(iv) a liquefaction module by means of a closed-cycle based refrigerator, the liquefaction module being adapted to vary the liquefaction rate to closely match the gas recovery rate, and therefore to match the consumption of liquefied gas of the connected equipment; and (v) two helium gas distribution management modules, one placed at the exit of the storage module and one at the exit of the purification module.

Maximum efficiency in the liquefaction of helium gas within this helium recovery plant is accomplished with an electronic control adapted to provide precise regulation of the vapor pressure within the Dewar. Each pressure value "P" at which liquefaction is performed within the helium recovery plant has a corresponding liquefaction rate "$T_l$," expressed in liters/hour, whereas "$T_l$" is an increasing function of "P."

This helium recovery plant is adapted to adjust the liquefaction rate of helium gas and thus minimizes the storage time lapse of the evaporated gas and therefore reduces the acquired impurities therein. The volume of the stored gas prior to liquefaction is also minimized which simplifies the plant. Furthermore, the liquefier allows permanent storage of the produced liquid within its own thermally insulated Dewar, during which the system is operated in a standby mode with a zero liters/hour liquefaction rate and a loss of or approaching 0%, thus providing a reserve of liquefied helium for its immediate on-demand use.

This helium recovery plant is scalable by increasing the number of liquefaction units, resulting in a simplified procedure. Moreover, as the available power of closed-cycle refrigerators continues to increase, fewer refrigerators will be required in each liquefaction unit within the plant.

BRIEF DESCRIPTION OF THE DRAWING

To complement this description and aid in a better understanding of the features of this concept, and in accordance with an example of the preferred embodiment thereof, a drawing is provided as an integral part of such description, as a way of illustrating in a non-exhaustive manner the following details wherein:

FIG. 1 is a schematic of a helium recovery plant and its elements as well as their interrelations in accordance with an embodiment of the invention.

DETAILED DESCRIPTION OF THE PREFERRED EMBODIMENTS

Now turning to FIG. 1, a preferred embodiment for the helium recovery plant is described below.

Helium recovery plant 1 comprises five modules: recovery module 2; gas collection and storage module 3: purification module 4; liquefaction module 5; and distribution modules 6 and 26.

In the recovery module, helium gas is recovered from one or more individual scientific or medical equipments 7 by means of back-pressure control modules 8 that control the pressures in the individual equipments between the maximum and minimum pressure conditions of equipments 7, making such equipment independent from the rest of the modules (3, 4, 5, 6, 26) and ensuring a recovery with no or minimal helium losses. The back pressure control modules comprise conventional electronic pressure sensors and safety and shut-off valves to evacuate excess helium gas in the chance that excessive and unforeseen evaporation occurs in equipments 7.

Once recovered through back-pressure control modules 8, the helium gas proceeds to gas collection and storage module 3, where it is collected in one or more balloons or atmospheric pressure storage containers 9 with a volume specially suited for the requirements of the plant.

Each container 9, or other recovery device, is equipped with conventional volume (full-or-empty) sensors and safety devices to ensure proper filling, that is, "correct loading," and avoid any damages to plant 1, as well as to allow its management through plant control software programmed within CPU 100.

From container 9 the helium gas then passes through filter 10 and oil-less compressor 11 to be stored at the output pressure of the compressor 11, greater than 2 bar, in compressed gas storage container 12 with a volume determined by the requirements of the plant. While it is contemplated that the storage containers will be matched to the compressors, it is not necessary that there be one container 9 and one connected filter 10 for each compressor 11 or for each container 12 in each recovery line.

A balloon or storage container 9, an oil-less compressor 11, a filter 10, and a compressed gas storage container 12 together form one recovery line of storage module 3. Depending on the dimensions of the recovery plant, themselves determined by the number of liters of evaporated gas generated by equipments 7, multiple recovery lines may be necessary, as shown in the drawing.

The distribution and flow of gas coining from one or more recovery lines is regulated by gas distribution and management module 6, including one or more conventional flow control valves, relief valves, and shut off valves, referred to collectively by reference numeral 16, being controlled by the recovery plant control software of CPU 100 to route the helium gas to one or more purifiers 13. In addition, contaminants in the recovered helium can optionally be monitored with gas analyzer 15 and gaseous helium can be added to the system if and as necessary via external storage container 17.

Prior to the liquefaction of the stored helium gas, at pressures below 2 bar, it is necessary to remove all impurities that may remain through purifiers 13. The purifiers can be based on known closed-cycle refrigerator technologies of one or more stages, with a base temperature of <30 Kelvin (K). The helium gas circulates through each stage of the purifiers at the supply pressure of liquefiers 14 such that contaminant gases condense on the cold stages of the purifier and are thus removed from the helium gas. Depending on the class of the liquefaction plant, more than one purifier 13 may be required, as shown. Liquefiers 14 operate in a conventional manner so they are not described in detail here.

The purified helium gas coming from purifiers 13 is distributed through a second gas distribution and management module 26, including one or more flow control valves, relief valves, and shut off valves, collectively 24, being controlled by the recovery plant control software of CPU 100 to route the helium gas to one or more liquefiers 14. This second gas distribution and management module 26 also serves to supply the gaseous helium to the one or more liquefiers at the optimal pressure for the desired liquefaction rate. Helium gas leaving purifiers 13 can optionally be checked for any remaining contaminants via gas analyzer 25 in module 26.

Via second gas distribution and management module 26, the purified helium then flows to one or more liquefiers 14 where the gaseous helium is liquefied. The number of liquefiers, N, can be selected to meet the liquefaction rate of the helium recovery plant, and each liquefier can have multiple closed-cycle refrigerators, M, independently disposed in the N liquefiers. The liquefiers may comprise a vacuum insulated container or Dewar, at least one liquefaction compressor, and at least one closed-cycle refrigerator having one or more cooling stages thereof. Additionally, a liquefier may further comprise an electronic pressure regulator adapted to regulate the incoming gas headed into the Dewar; a mass-flow meter adapted to measure the incoming gas coming into the Dewar; a gas-volume totalizer; a pressure sensor adapted to measure the pressure inside the insulated Dewar; a thermometer arranged in each one of the stages of the closed-cycle refrigerator; a sensor adapted to determine a liquefied gas level controlled by a liquefied gas level controller; safety valves arranged in the insulated Dewar; a means to eliminate Taconis oscillations; and a liquefied gas transfer plug adapted to enable extraction of liquefied gas. Assuming each liquefier is built identically, the maximum liquefaction rate expressed in liters/hour will be $(T_l)_{max}=N\cdot M\cdot T_l$, where $T_l$ is the liquefaction rate of one liquefier. The volume of the liquefiers, where the helium gas is liquefied and stored, can similarly be adapted to the desired size and liquefaction rate of the helium recovery plant. As stated previously, the various elements of liquefiers 14 are not separately shown or described because they are constructed and operate in a conventional manner.

Class M liquefaction rates can be achieved with three liquefiers 14, each one having three double-stage refrigerators that perform 1.5 W at the second stage, with the advantage of plant 1 being able to liquefy at any rate from zero liters/hours (in the standby mode) up to the maximum rate of $(T_l)_{max}$, and at a performance which adjusts according to the rate of the recovered helium gas. This feature is useful for reducing or eliminating helium losses.

The ability to modify the liquefaction rate allows the helium recovery plant to adapt to the rate at which helium is recovered within the system, and thereby to adapt to the liquid helium consumption rate of helium gas using equipments 7. This minimizes the storage time of the liquefied helium as well as the helium gas volume stored prior its liquefaction.

Plant 1 can operate in a standby mode in which there is no external helium supply to the thermal flask or Dewar of liquefier 14, corresponding to a liquefaction rate of 0 liters/hour and 0% loss, and thus maintaining a liquid helium stock for immediate use. The function of the plant is to re-condense the thermal-based loss of evaporated helium in the liquefier Dewar, maintaining its pressure between two fixed values, minimum pressure ($P_{min}$) and maximum pressure ($P_{max}$). Once the Dewar of liquefier 14 is full of liquid helium, the control software automatically stops the incoming flow of helium to the liquefier Dewar, while a refrigerator compressor from the liquefier continues to work so that the portion of the vapor in equilibrium with the liquid helium is liquefied inside that Dewar while its pressure decreases. When the pressure has decreased to the $P_{min}$ value, the control software switches off the refrigerator compressor, and stops the vapor condensation process. Immediately after, the liquid helium begins evaporating due to thermal losses registered in the Dewar of the liquefier, which causes the pressure to increase gradually. When the pressure in the liquefier Dewar reaches the $P_{max}$ value, the control software initiates the refrigerator's compressor and therefore restarts the condensation of vapor inside the liquefier Dewar, again decreasing the pressure to $P_{min}$ value and repeating the above process, until the decision is made to terminate the standby mode and proceed to extract the liquid helium from the Dewar of the liquefier and distribute it to equipment 7.

Electronics and the fully-automatic computerized control software are provided to control the recovery plant as shown in such a way that only one operator needs to be present for the transfer of liquid helium and maintenance operations recommended by the manufacturer of the refrigerator of liquefier 14. In another embodiment, the computerized control software is programmed within a CPU and adapted to control each of recovery module 2; pressurized storage module 3; purification module 4; liquefaction module 5; and first and second distribution modules in accordance with one or more pre-programmed settings. In another embodiment, the computerized control software is adapted to control each of recovery module 2; pressurized storage module 3; purification module 4; liquefaction module 5; and first and second distribution modules to accomplish zero liquefaction within the liquefaction module in accordance with the standby mode. Additionally, when in the standby mode, the liquefaction module is adapted to provide a liquefaction rate equal to the boil-off rate of helium gas within the Dewar.

In a related aspect, a method for recovery and liquefaction of gas from helium gas-using equipments comprises: (i) at a recovery module, recovering gas from one or more helium gas using equipments; (ii) filtering, compressing, and storing the gas at a pressurized storage module; (iii) using one or more refrigerators of a purification module, removing impurities from the gas; (iv) liquefying the gas using one or more liquefiers of a liquefaction module; and (v) storing the liquefied gas in a storage module; wherein the liquefying is performed at a liquefaction rate that is similar to a recovery rate at which gas is recovered from the helium gas-using equipments. Additionally, a CPU can be used to control the various modules of the helium recovery plant such that the liquefaction rate is matched with the recovery rate. Moreover, in a standby mode the CPU can dynamically control various modules of the helium recovery plant for adjusting a cooling power of the one or more refrigerators to match a thermal heat load of the one or more Dewars containing the refrigerators to effectuate a liquefaction rate of zero where zero gas is being used by the helium gas-using equipments.

The invention claimed is:

1. A helium recovery plant for recovering helium from helium-using equipment, the recovery plant comprising:

a recovery module coupled to the helium gas using equipment, said recovery module being adapted to recover gas-phase helium from the helium-using equipment:

a gas-collection and storage module coupled to said recovery module, said storage module being adapted to filter, compress, and store the recovered gas-phase helium of said recovery module;

a purification module coupled to said storage module, said purification module comprising one or more refrigerators adapted to remove impurities from the recovered gas-phase helium to form an amount of purified gas-phase helium;

a first distribution management module comprising a first distribution means, said first distribution management module being disposed between said storage module and said purification module and adapted to regulate a flow of the gas-phase helium from said storage module to said purification module;

a liquefaction module comprising one or more liquefiers, said liquefaction module being adapted to liquefy the purified gas-phase helium into liquid-phase helium using said one or more liquefiers;

a second distribution management module comprising a second distribution means, said second distribution management module being disposed between said purification module and said liquefaction module and adapted to regulate a flow of gas therebetween; and a gas storage tank for storage of helium gas, said gas storage tank being disposed in parallel with said storage module and adapted to receive and store purified helium gas from said purification module and to provide the purified helium gas Directly into said first and second distribution management modules.

2. The recovery plant of claim 1, wherein said gas collection and storage module comprises at least one atmospheric pressure storage container and at least one filter disposed in series with said at least one atmospheric pressure storage container.

3. The recovery plant of claim 2, wherein said gas collection and storage module further comprises at least one compressor for compressing gas received from said at least one filter, and at least one compressed gas storage container for storing compressed gas from received from said a least one compressor.

4. The recovery plant of claim 2, wherein said atmospheric pressure storage container is a balloon.

5. The recovery plant of claim 1, wherein at least one of said one ore more refrigerators of the purification module comprises a close-cycle refrigerator comprising one or more cooling stages.

6. The recovery plant of claim 1, wherein said liquefaction module comprises a Dewar, at least one liquefaction compressor, and at least one closed-cycle refrigerator comprising one or more cooling stages.

7. The recovery plant of claim 1, further comprising a CPU having computerized control software programmed therein, the computerized control software being adapted to control each of said recovery module; said gas collection and storage module; said purification module; said liquefaction module; and said first and second distribution modules in accordance with one or more pre-programmed settings.

8. The recovery plant of claim 7, wherein said computerized control software is adapted to control each of: the recovery module; said gas collection and storage module; said purification module; said liquefaction module; and said first and second distribution modules to accomplish zero liquefaction within the liquefaction module in accordance with a standby mode.

9. The recovery plant of claim 6, wherein said liquefaction module is adapted to provide a liquefaction rate equal to a boil-off rate of helium gas within said Dewar.

10. The helium gas recovery plant of claim 1, wherein said liquefaction module is adapted to provide a liquefaction rate equal to a usage rate of the helium-using equipment.

11. The helium gas recovery plant of claim 1, wherein said first distribution module further comprises a first gas analyzer.

12. The helium gas recovery plant of claim 1, wherein said second distribution module further comprises a second gas analyzer.

13. The recovery plant of claim 1 adapted for continuous operation between a liquefaction mode having a liquefaction rate of about ten liters/hour and a standby mode having a liquefaction rate of zero liters/hour.

14. The recovery plant of claim 1 adapted to recycle helium gas therein.

15. A method for recovery and liquefaction of helium gas from helium gas-using equipments, comprising:

at a recovery module, recovering gas from one or more helium gas-using equipments;

filtering, compressing, and storing said gas at a gas collection and storage module;

removing impurities from said gas via one or more refrigerators of a purification module;

distributing and managing the flow of the gas-phase helium between a storage tank and the purification modules;

distributing and managing the flow of the gas-phase helium between the purification and liquefaction modules;

liquefying said gas using a liquefaction module, said liquefaction module comprising at least one Dewar and a refrigerator disposed therein; and storing said liquefied gas in said at least one Dewar of the liquefaction module;

wherein said liquefying is performed at a liquefaction rate that is similar to a recovery rate at which gas is recovered from the helium gas-using equipments.

16. The method of claim 15, wherein it said liquefaction module said liquefying is dynamically controlled using a CPU for matching said liquefaction rate with said recovery rate.

17. The method of claim 16, wherein at said liquefaction module said liquefying is dynamically controlled using said CPU for adjusting a cooling power of the refrigerator to match a thermal heat load of the Dewar to effectuate a liquefaction rate of zero in a standby mode.

* * * * *

UNITED STATES PATENT AND TRADEMARK OFFICE

CERTIFICATE OF CORRECTION

PATENT NO. : 8,973,397 B2
APPLICATION NO. : 13/452630
DATED : March 10, 2015
INVENTOR(S) : Rillo Millán et al.

It is certified that error appears in the above-identified patent and that said Letters Patent is hereby corrected as shown below:

In the specification

Column 4, line 53: "coining" should read --coming--

Signed and Sealed this
Seventh Day of June, 2016

Michelle K. Lee

Michelle K. Lee
*Director of the United States Patent and Trademark Office*